US010801335B2

(12) United States Patent
Umehara et al.

(10) Patent No.: US 10,801,335 B2
(45) Date of Patent: Oct. 13, 2020

(54) ROTARY MACHINE

(71) Applicant: MITSUBISHI HEAVY INDUSTRIES, LTD., Tokyo (JP)

(72) Inventors: Ryuichi Umehara, Tokyo (JP); Haruko Shiraishi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 48 days.

(21) Appl. No.: 16/360,425

(22) Filed: Mar. 21, 2019

(65) Prior Publication Data

US 2019/0301288 A1 Oct. 3, 2019

(30) Foreign Application Priority Data

Mar. 28, 2018 (JP) ..... 2018-062691

(51) Int. Cl.
*F01D 5/22* (2006.01)

(52) U.S. Cl.
CPC ..... *F01D 5/22* (2013.01); *F05D 2220/32* (2013.01); *F05D 2260/96* (2013.01)

(58) Field of Classification Search
CPC ..... F01D 5/10; F01D 5/16; F01D 5/22; F01D 25/04; F01D 25/06; F05D 2220/32; F05D 2260/96
See application file for complete search history.

(56) References Cited

U.S. PATENT DOCUMENTS 4,455,122 A * 6/1984 Schwarzmann ..... F01D 5/26 416/190
4,516,910 A * 5/1985 Bouiller ..... F01D 5/22 416/190
5,261,790 A * 11/1993 Dietz ..... F01D 5/22 416/193 A
5,599,170 A * 2/1997 Marchi ..... F01D 5/22 416/190
6,478,544 B2 * 11/2002 Brandl ..... F01D 5/22 416/190
6,932,575 B2 * 8/2005 Surace ..... F01D 5/22 416/193 A (Continued)

FOREIGN PATENT DOCUMENTS

JP 2003-97216 4/2003
JP 2013-513754 4/2013
JP 2016-217349 12/2016

*Primary Examiner* — Igor Kershteyn
(74) *Attorney, Agent, or Firm* — Wenderoth, Lind & Ponack, L.L.P.

(57) ABSTRACT

In a rotary machine, one of platforms adjacent to each other in a peripheral direction has a first abutting surface extending in a radial direction and against which damper pins abut, and the rotary machine includes: a first moving member installed to be movable in the peripheral direction between the platforms adjacent to each other in the peripheral direction and on which a second damper abutting surface against which the damper pins abut is formed while a relative distance with the first damper abutting surface decreases as opposing the first damper abutting surface in the peripheral direction and approaching the outer side in the radial direction; and a spring member biasing the first moving member toward one side in the peripheral direction which is one platform side.

8 Claims, 6 Drawing Sheets

(56) References Cited

U.S. PATENT DOCUMENTS

| | | | | |
|---|---|---|---|---|
| 8,167,563 | B2 * | 5/2012 | Kayser | F01D 5/22 416/190 |
| 8,672,626 | B2 * | 3/2014 | Boy | F01D 5/26 416/1 |
| 9,194,238 | B2 * | 11/2015 | Roberts, III | F01D 5/3084 |
| 2011/0142650 | A1 | 6/2011 | Beeck | |
| 2016/0333704 | A1 | 11/2016 | Annaluri et al. | |

* cited by examiner

ROTARY MACHINE

BACKGROUND OF THE INVENTION

Field of the Invention

The present invention relates to a rotary machine. Priority is claimed on Japanese Patent Application No. 2018-62691, filed on Mar. 28, 2018, the contents of which are incorporated herein by reference.

Description of Related Art

In rotary machines, such as gas turbines or jet engines, a configuration is known in which dampers are each provided between turbine rotor blades adjacent to each other. The damper comes into contact with the turbine rotor blade when the rotary machine rotates. In addition, when an excitation force acts on the turbine rotor blade and vibration occurs, the vibration is attenuated by a frictional force at a contact location between the damper and the turbine rotor blade.

For example, Japanese Unexamined Patent Application, First Publication No. 2016-217349 discloses a rotary machine provided with damper pins that come into contact with both of the platforms of turbine rotor blades adjacent to each other.

SUMMARY OF THE INVENTION

However, various vibration modes occur at the time of increase or decrease of a rotational speed of the rotary machine. However, the damper pins are designed to obtain attenuation when reaching a predetermined vibration amplitude. Therefore, although it is possible to appropriately apply attenuation for a specific vibration mode, there is a case where appropriate attenuation cannot be obtained for vibration modes with small or large amplitudes at the time of increase and decrease of the rotational speed.

Considering such a situation, an object of the present invention is to provide a rotary machine which can apply appropriate attenuation in accordance with a rotational speed.

According to a first aspect of the present invention, a rotary machine includes: a rotating shaft configured to rotate around an axial line; a plurality of rotor blades which are arranged in a peripheral direction on an outer peripheral side of the rotating shaft, and each having a blade root attached to the rotating shaft, a platform installed on an outer side of the blade root in a radial direction, and a blade main body extending to the outer side from the platform in the radial direction; and damper pins each installed on an inner side of the platform in the radial direction between the rotor blades adjacent to each other, in which one of the platforms adjacent to each other in the peripheral direction has a first abutting surface extending in the radial direction and against which the damper pins abut, a first moving member which is installed to be movable relative to the first damper abutting surface between the platforms adjacent to each other in the peripheral direction and on which a second damper abutting surface against which the damper pins abut is formed while a relative distance with the first damper abutting surface decreases as opposing the first damper abutting surface in the peripheral direction and approaching the outer side in the radial direction, and a biasing member configured to bias the first moving member toward the damper pins abutting against the second damper abutting surface.

According to the configuration, when a centrifugal force acting on the damper pin changes due to the change in rotational speed of the rotary machine, a pressing force from the damper pin to the first damper abutting surface and the second damper abutting surface changes. At this time, due to the balance between the pressing force acting on the first moving member via the second damper abutting surface and the biasing force acting on the first moving member from the biasing member, a relative position between the second damper abutting surface and the first damper abutting surface in the first moving member changes. Then, the contact position of the damper pin with respect to the first damper abutting surface and the second damper abutting surface changes. Accordingly, it is possible to change the attenuation by the damper pin in accordance with the rotational speed.

In the aspect, a coefficient of friction may change in a direction in which at least one of the first damper abutting surface and the second damper abutting surface extends in a sectional view orthogonal to the axial line.

Accordingly, with the change of the contact position of the damper pin, it is possible to change a frictional force generated in a contact location in any manner. Accordingly, it is possible to apply necessary attenuation in accordance with the rotational speed.

In the aspect, the first moving member may be installed to be movable in the peripheral direction, and the biasing member may be a spring member which is installed between the other platform and the first moving member and elastically biases the first moving member to one side in the peripheral direction.

The position in the peripheral direction of the first moving member changes due to the balance between the pressing force from the damper pin and the biasing force from the spring member. Accordingly, since the contact position of the damper pin changes, it is possible to change the attenuation in accordance with the rotational speed.

In the aspect, the first moving member may be installed to be movable in the radial direction, and the biasing member may be a spring member which is installed between the other platform and the first moving member and elastically biases the first moving member to the inner side in the radial direction.

The position in the radial direction of the first moving member changes due to the balance between the pressing force from the damper pin and the biasing force from the spring member. Accordingly, since the contact position of the damper pin changes, it is possible to change the attenuation in accordance with the rotational speed.

In the aspect, the first moving member may be installed to be movable in the peripheral direction, and have a pressure-receiving surface that is formed in an end portion on the other platform side and extends toward the other side in the peripheral direction as approaching the outer side in the radial direction, the other platform may have an opposing surface opposite to the pressure-receiving surface in the peripheral direction, and the biasing member may be capable of abutting against both the pressure-receiving surface and the opposing surface, and is movable in the radial direction.

Since the biasing member is movable in the radial direction, when the centrifugal force acts on the biasing member, the biasing member presses the pressure-receiving surface of the first moving member in accordance with the centrifugal force. The position in the peripheral direction of the first moving member changes due to the balance between the pressing force acting on the pressure-receiving surface from the biasing member and the pressing force acting from the damper pin. Accordingly, as described above, since the contact position of the damper pin changes, it is possible to change the attenuation in accordance with the rotational speed.

In the aspect, the biasing member may have a first sliding abutting surface slidablly abutting against the pressure-receiving surface, and a second sliding abutting surface slidably abutting against the opposing surface.

Accordingly, the second moving member presses the first moving member to one side in the peripheral direction in accordance with the centrifugal force. The position in the peripheral direction of the first moving member changes due to the balance between the pressing force from the second moving member and the pressing force by the damper pin. Therefore, as described above, since the contact position of the damper pin changes, it is possible to change the attenuation in accordance with the rotational speed.

In the aspect, the biasing member may be a biasing damper pin extending uniformly in the axial line direction, and in which an outline having a sectional shape orthogonal to the axial line is a non-rotation target shape.

Since the biasing damper pin has the non-rotational target shape, the contact location between the biasing damper pin and the pressure-receiving surface randomly changes when the centrifugal force is applied. Accordingly, the pressing force acting on the pressure-receiving surface from the biasing damper pin changes. Therefore, as described above, since the contact position of the damper pin changes due to the change of the position in the peripheral direction of the first moving member, it is possible to change the attenuation in accordance with the rotational speed.

In the aspect, in the biasing damper pin, the outline having a sectional shape orthogonal to the axial line may be formed of a plurality of arcs which are convex outward and have radiuses of curvature different from each other, and a plurality of line segments connecting the arcs to each other.

Accordingly, it is possible to easily and randomly change the contact location between the biasing damper pin and the pressure-receiving surface.

According to the rotary machine of the present invention, it is possible to apply necessary appropriate attenuation in accordance with the rotational speed.

DETAILED DESCRIPTION OF THE INVENTION

First Embodiment

Hereinafter, a gas turbine 1 according to a first embodiment of the present invention will be described with reference to FIGS. 1 to 3.

Figure 1:
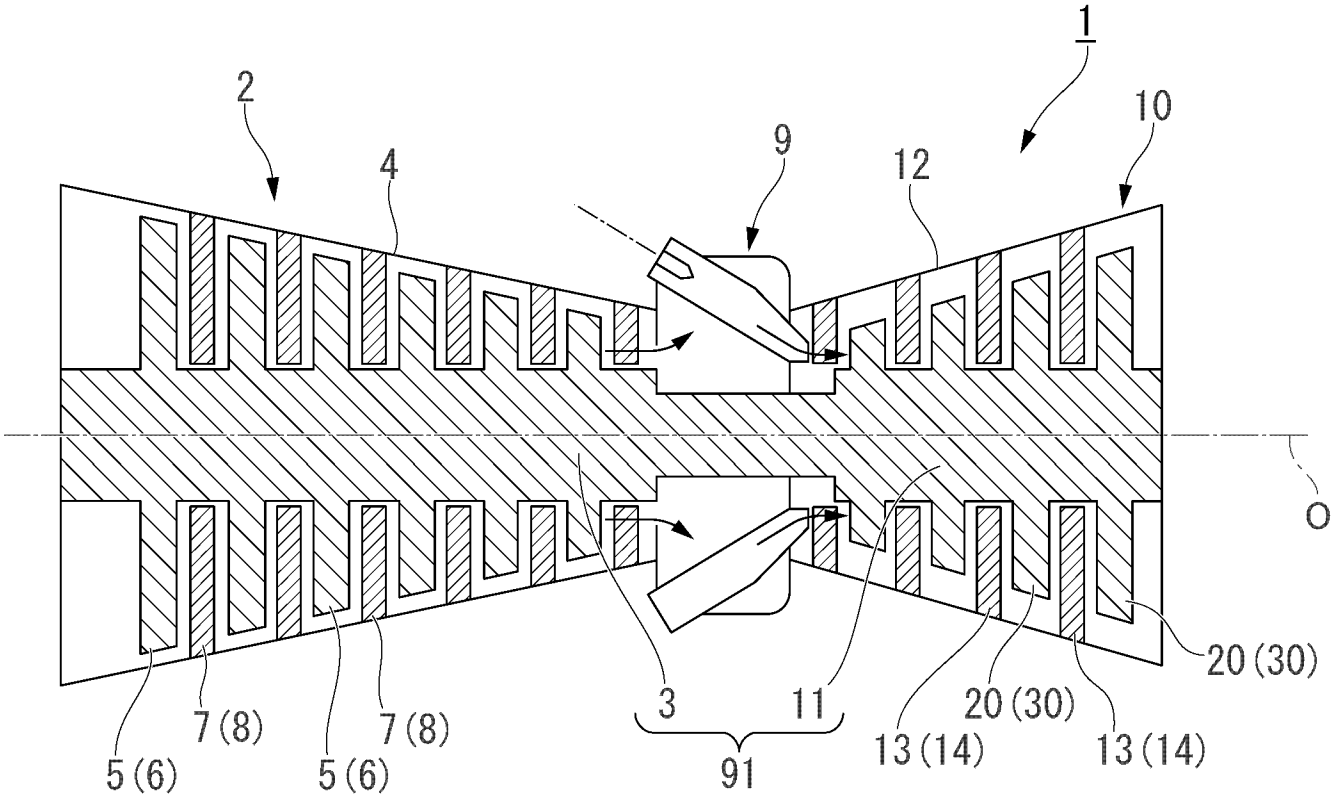
FIG. 1 is a schematic vertical sectional view of a gas turbine according to a first embodiment.
Figure 2:
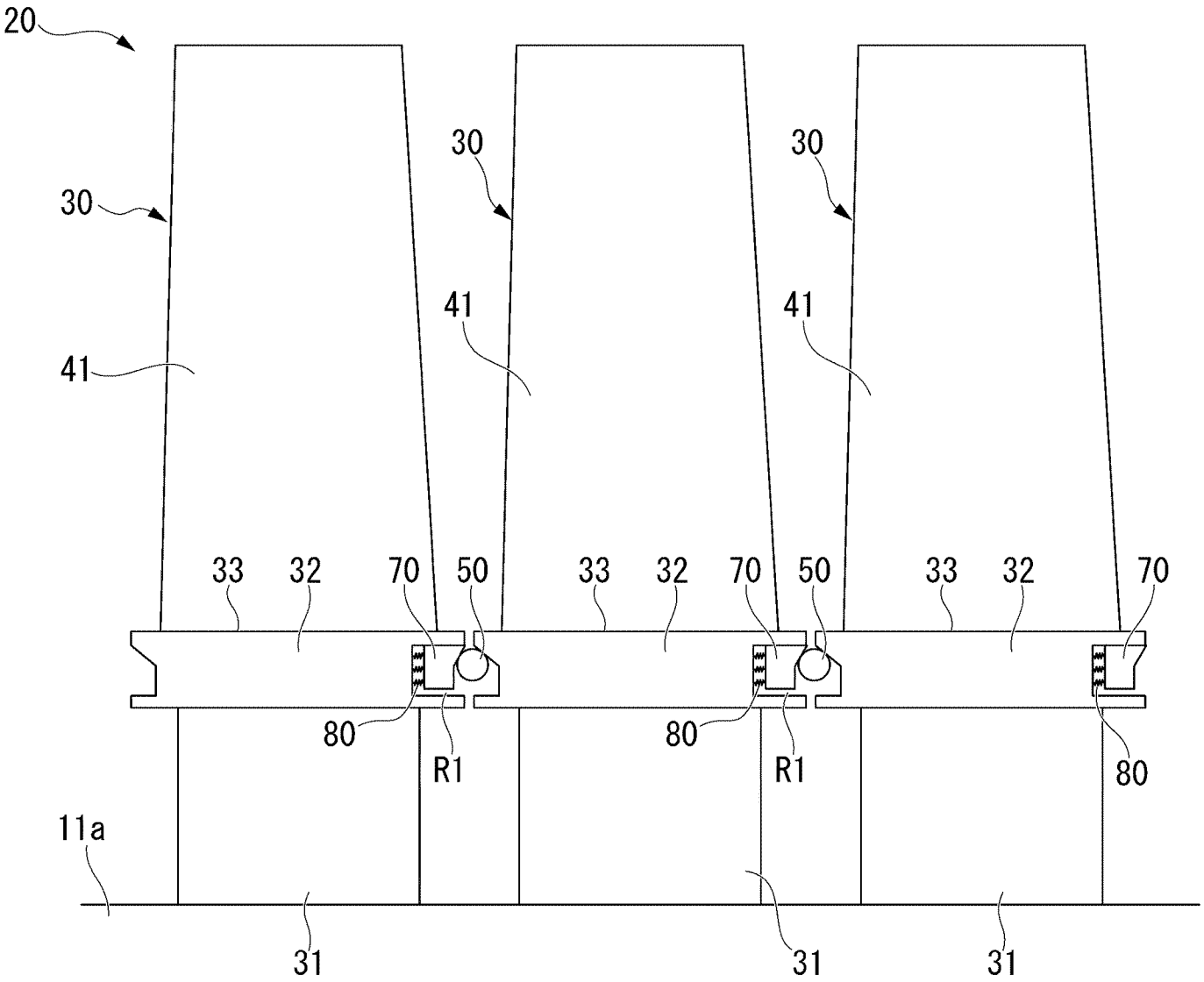
FIG. 2 is a schematic view of a rotor blade group of the gas turbine according to the first embodiment when viewed from an axial line direction.

As illustrated in FIG. 1, the gas turbine 1 according to the present embodiment includes a compressor 2 generating compressed air, a combustor 9 generating combustion gas by mixing and combusting fuel with the compressed air, and a turbine 10 that is driven by the combustion gas.

The compressor 2 includes a compressor rotor 3 configured to rotate around an axial line O, and a compressor casing 4 covering the compressor rotor 3 from an outer peripheral side. The compressor rotor 3 has a columnar shape extending along the axial line O. A plurality of compressor rotor blade stages 5 arranged at intervals in an axial line O direction are installed on an outer peripheral surface of the compressor rotor 3. Each of the compressor rotor blade stages 5 includes a plurality of compressor rotor blades 6 arranged at intervals in a peripheral direction of the axial line O on the outer peripheral surface of the compressor rotor 3.

The compressor casing 4 has a cylindrical shape around the axial line O. A plurality of compressor stationary blade stages 7 arranged at intervals in the axial line O direction are installed on an inner peripheral surface of the compressor casing 4. The compressor stationary blade stages 7 are alternately arranged with respect to the compressor rotor blade stages 5 when viewed from the axial line O direction. Each of the compressor stationary blade stages 7 includes a plurality of compressor stationary blades 8 arranged at intervals in the peripheral direction of the axial line O on the inner peripheral surface of the compressor casing 4.

The combustor 9 is installed between the compressor casing 4 and a turbine casing 12 which will be described later. The compressed air generated by the compressor 2 is mixed with a fuel on the inside of the combustor 9 to become a premixed gas. In the combustor 9, the combustion gas having a high temperature and a high pressure is generated by combusting the premixed gas. The combustion gas is introduced into the turbine casing 12 to drive the turbine 10.

The turbine 10 includes a turbine rotor 11 configured to rotate around the axial line O, and the turbine casing 12 covering the turbine rotor 11 from the outer peripheral side. The turbine rotor 11 has a columnar shape extending along the axial line O. A plurality of turbine rotor blade stages 20 arranged at intervals in the axial line O direction are installed on an outer peripheral surface of the turbine rotor 11. Each of the turbine rotor blade stages 20 includes a plurality of turbine rotor blades 30 arranged at intervals in the peripheral direction of the axial line O on the outer peripheral surface of the turbine rotor 11. The turbine rotor 11 is integrally connected to the compressor rotor 3 in the axial line O direction to form the gas turbine rotor.

The turbine casing 12 has a cylindrical shape around the axial line O. A plurality of turbine stationary blade stages 13 arranged at intervals in the axial line O direction are installed on an inner peripheral surface of the turbine casing 12. The turbine stationary blade stages 13 are alternately arranged with respect to the turbine rotor blade stages 20 when viewed from the axial line O direction. Each of the turbine stationary blade stages 13 includes a plurality of turbine stationary blades 14 arranged at intervals in the peripheral direction of the axial line O on the inner peripheral surface of the turbine casing 12. The turbine casing 12 is connected to the compressor casing 4 in the axial line O direction to form the gas turbine casing. In other words, the gas turbine rotor is integrally rotatable around the axial line O in the gas turbine casing.

Turbine Rotor Blade

Next, the turbine rotor blade 30 will be described in more detail with reference to FIG. 2.

The turbine rotor blade 30 has a blade root 31, a platform 32, and a blade main body 41.

The blade root 31 is a part attached to the turbine rotor 11 in the turbine rotor blade 30. The turbine rotor 11 is configured by stacking a plurality of disk-like disks 11*a* around the axial line O in the axial line O direction. The blade root 31 is integrally attached to the disk 11*a* by being inserted from the axial line O direction into a recessed groove (not illustrated) of the disk 11*a* formed on the outer peripheral surface of the disk 11*a*. Accordingly, the turbine rotor blades 30 are radially disposed at intervals in the peripheral direction with respect to the disk 11*a*.

The platform 32 is integrally formed on the outer side of the blade root 31 in the radial direction. The platform 32 projects from an end portion on the outer side of the blade root 31 in the radial direction in the axial line O direction and in the peripheral direction. An outer peripheral surface 33 facing the outer side in the platform 32 in the radial direction is exposed to the combustion gas passing through the turbine 10.

The blade main body 41 extends toward the outer side from the outer peripheral surface 33 of the platform 32 in the radial direction. In other words, a base end of the blade main body 41 is integrally connected to the end portion on the outer side of the platform 32 in the radial direction. The blade main body 41 has a blade-shaped sectional shape orthogonal to an extending direction of the blade main body 41.

Figure 3:
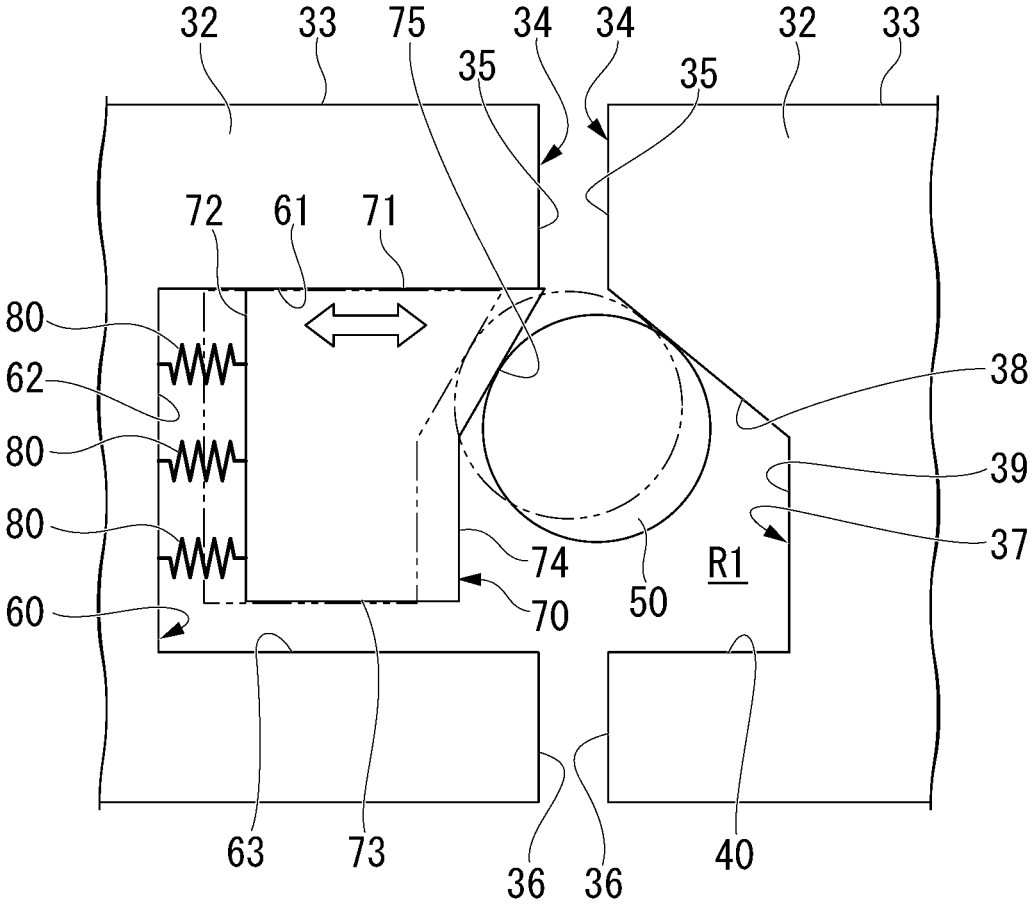
FIG. 3 is an enlarged view of an essential part of FIG. 2 and is a view of platforms adjacent to each other of the gas turbine according to the first embodiment when viewed from the axial line direction.

Here, as illustrated in FIG. 3, a platform side surface 34 facing the peripheral direction in the platform 32 extends in the radial direction and in the axial line O direction. Platform side surfaces 34 oppose each other in the peripheral direction between the platforms 32 of the turbine rotor blades 30 adjacent to each other.

Of the platforms 32 adjacent to each other, a first recess portion 37 that is recessed from the platform side surface 34 and extends in the axial line O direction is formed on the platform side surface 34 of one platform 32 on one side (right side in FIG. 3) in the peripheral direction. The platform side surfaces 34 are divided by the first recess portion 37 in the radial direction. On the platform side surface 34, a part on the outer side of the first recess portion 37 in the radial direction is an outer peripheral side surface 35, and a part on the inner side of the first recess portion 37 in the radial direction is an inner peripheral side surface 36.

A surface facing the inner side in the first recess portion 37 of one of the platforms 32 in the radial direction is a first damper abutting surface 38. The first damper abutting surface 38 is in a shape of a flat surface parallel to the axial line O. The first damper abutting surface 38 extends being inclined toward the other side (left side in FIG. 3) in the peripheral direction as approaching the outer side in the radial direction, and is connected to the outer peripheral side surface 35.

The end portion on the side opposite to the outer peripheral side surface 35 in the first damper abutting surface 38 is connected to the end portion on the outer side of a first recess portion bottom surface 39 in the radial direction that is parallel to the axial line O and extends in the radial direction. Between the end portion on the inner side in the radial direction and the end portion on the outer side in the radial direction of the inner peripheral side surface 36 in the first recess portion bottom surface 39, a first recess portion lower surface 40 that is parallel to the axial line O and extends in the peripheral direction is formed.

Of the platforms 32 adjacent to each other, a second recess portion 60 that is recessed from the platform side surface 34 and extends in the axial line O direction is formed on the platform side surface 34 of the other platform 32 on the other side in the peripheral direction. The platform side surfaces 34 are divided by the second recess portion 60 in the radial direction. On the platform side surface 34, a part on the outer side of the second recess portion 60 in the radial direction is an outer peripheral side surface 35, and a part on the inner side of the second recess portion 60 in the radial direction is an inner peripheral side surface 36.

A surface facing the inner side in the second recess portion 60 of the other one of the platforms 32 in the radial direction is a second recess portion upper surface (guide surface) 61. The second recess portion upper surface 61 is in a shape of a flat surface parallel to the axial line O. The second recess portion upper surface 61 is in a shape of a flat surface extending in the peripheral direction. In other words, the second recess portion upper surface 61 extends in a shape of a flat surface along a tangent of a virtual circle centered on the axial line O. The end portion on one side of the second recess portion upper surface 61 in the peripheral direction is connected to the end portion on the inner side of the outer peripheral side surface 35 in the radial direction.

The end portion on the side opposite to the outer peripheral side surface 35 in the second recess portion upper surface 61 is connected to the end portion on the outer side of a second recess portion bottom surface (opposing surface) 62 in the radial direction that is parallel to the axial line O and extends in the radial direction. Between the end portion on the inner side in the radial direction and the end portion on the outer side in the radial direction of the inner peripheral side surface 36 in the second recess portion bottom surface 62, a second recess portion lower surface 63 that is parallel to the axial line O and extends in the peripheral direction is formed.

An accommodation space R1 extending so as to penetrate the platform 32 in the axial line O direction according to the shape of the first recess portion 37 and the second recess portion 60 is defined by the first recess portions 37 and the second recess portion 60 of the platforms 32 adjacent to each other. The accommodation space R1 is formed between all of the platforms 32 adjacent to each other. Therefore, the same number of accommodation spaces R1 as the number of the turbine rotor blades 30 are formed.

First Moving Member

As illustrated in FIG. 3, a first moving member 70 is installed in the accommodation space R1. The first moving member 70 is accommodated in the second recess portion 60 of the other platform 32. The first moving member 70 extends in a uniform outer shape in the axial line O direction. The first moving member 70 has an outer peripheral surface (guided surface) 71 which is slidably disposed on the second recess portion upper surface 61 and extends in the peripheral direction in parallel to the second recess portion upper surface 61. As the outer peripheral surface 71 is guided to the second recess portion upper surface 61, the first moving member 70 is movable relative to the first damper abutting surface 38 of the other platform 32 in the peripheral direction. Coating for reducing the coefficient of friction may be formed on at least one of the outer peripheral surface 71 and the second recess portion upper surface 61.

In the end portion on the other side on the second recess portion upper surface 61 of the first moving member 70 in the peripheral direction, a rear surface 72 which is disposed at intervals in the peripheral direction with the second recess portion bottom surface 62 and extends in the radial direction in parallel to the second recess portion bottom surface 62 is formed. The rear surface 72 opposes the second recess portion bottom surface 62 and the second recess portion 60 in the peripheral direction. In the end portion on the inner side of the rear surface 72 of the first moving member 70 in the radial direction, an inner peripheral side end surface 73 extending in parallel to the outer peripheral surface 71 in the peripheral direction and opposes the second recess portion lower surface 63 in the radial direction is formed. On the surface facing the one side in the first moving member 70 in the peripheral direction, a front surface 74 extending toward the outer side in the radial direction from the end portion on one side in the peripheral direction in the inner peripheral side end surface 73 is formed. The front surface 74 extends in the radial direction in parallel to the rear surface 72.

On the surface facing the one side in the first moving member 70 in the peripheral direction, a second damper abutting surface 75 is formed between the end portion on the outer side of the front surface 74 in the radial direction and the end portion on the one side of the outer peripheral surface 71 in the peripheral direction. The second damper abutting surface 75 is in a shape of a flat surface parallel to the axial line O. The second damper abutting surface 75 is inclined toward the one side in the peripheral direction as approaching the outer side in the radial direction. The second damper abutting surface 75 opposes the first damper abutting surface 38 in the peripheral direction. A relative distance between the first damper abutting surface 38 and the second damper abutting surface 75 decreases as approaching the outer side in the radial direction. In other words, the first damper abutting surface 38 and the second damper abutting surface 75 are formed such that virtual extension surfaces of the first damper abutting surface 38 and the second damper abutting surface 75 intersect with each other on the outer side in the radial direction.

Here, in the present embodiment, the first damper abutting surface 38 and the second damper abutting surface 75 are configured such that the coefficient of friction changes in a direction extending in a sectional view orthogonal to the axial line O.

The first damper abutting surface 38 is formed such that the coefficient of friction gradually increases as approaching the outer side in the radial direction and the other side in the peripheral direction. The second damper abutting surface 75 is formed such that the coefficient of friction gradually increases as approaching the outer side in the radial direction and the other side in the peripheral direction. The coefficients of friction may be configured to gradually increase or may increase in stages.

The change in the coefficient of friction between the first damper abutting surface 38 and the second damper abutting surface 75 may be realized by changing the material and properties of the coating layer to be formed. In addition, the degree of surface processing in each of the first damper abutting surface 38 and the second damper abutting surface 75 may be realized by changing the degree in the direction in which the surfaces extend.

Spring Member

A spring member 80 (biasing member) is installed between the first moving member 70 and the second recess portion bottom surface 62 in the second recess portion 60 of the other platform 32. A plurality of spring members 80 are installed at intervals in the radial direction. The spring member 80 is installed so as to be extensible and contractible in the peripheral direction. The spring member 80 elastically biases the first moving member 70 to the one side in the peripheral direction with respect to the second recess portion bottom surface 62 by being disposed in a compressed state. As the spring member 80, various configurations, such as a coil spring and a leaf spring, can be adopted.

Damper Pin

As illustrated in FIG. 3, a damper pin 50 is installed in the accommodation space R1. In the present embodiment, the damper pin 50 is installed in a space divided by the first damper abutting surface 38, the first recess portion bottom surface 39, the first recess portion lower surface 40, the second recess portion lower surface 63, the front surface 74, and the second damper abutting surface 75 in the accommodation space R1. The damper pin 50 has a shape of a pin extending in the axial line O direction. In the damper pin 50, a sectional shape orthogonal to the axial line O is uniformly made in the axial line O direction. The diameter of the damper pin 50 is set to be larger than the interval between the side surfaces of the platforms 32 adjacent to each other.

Functional Effect

When the turbine 10 rotates, the damper pin 50 comes into contact with both the first damper abutting surface 38 and the second damper abutting surface 75 as the centrifugal force acts on the damper pin 50. At this time, a frictional force is generated between the damper pin 50 and the first damper abutting surface 38 and the second damper abutting surface 75. The attenuation based on the frictional force can suppress an excitation force of the turbine rotor blade 30.

Here, in present embodiment, when the centrifugal force acting on the damper pin 50 changes due to the change in rotational speed of the turbine 10, a pressing force from the damper pin 50 to the first damper abutting surface 38 and the second damper abutting surface 75 changes. At this time, due to the balance between the pressing force acting on the first moving member 70 via the second damper abutting surface 75 and the biasing force acting on the first moving member 70 from the spring member 80, a position in the peripheral direction of the first moving member 70 changes.

For example, at the time of high rotational speed in which the centrifugal force largely acts on the damper pin 50, as the pressing force of damper pin 50 becomes relatively large with respect to the biasing force of spring member 80, a state where the moving member has moved to the other platform 32 side which is the other side in the peripheral direction is achieved. In this case, the damper pin 50 abuts against a part on the outer side in the radial direction in the first damper abutting surface 38 and the second damper abutting surface 75.

Meanwhile, when the centrifugal force acting on the damper pin 50 is relatively small at the time of low rotational speed, since the pressing force of the damper pin 50 is small, the moving member moves to the one platform 32 side which is one side in the peripheral direction according to the biasing force of the spring member 80. In this case, compared to the time of high rotational speed, the damper pin 50 abuts against a part on the inner side in the radial direction in the first damper abutting surface 38 and the second damper abutting surface 75.

In this manner, in the present embodiment, the contact position of the damper pin 50 with respect to the first damper abutting surface 38 and the second damper abutting surface 75 changes in accordance with the rotational speed of the turbine 10. In other words, since the attenuation by the damper pin 50 also changes as the contact mode changes, it is possible to change the attenuation by the damper pin 50 in accordance with the rotational speed.

In addition, it is possible to suppress the wear of only a part of the first damper abutting surface 38 and the second damper abutting surface 75 by changing the contact location in accordance with the rotational speed.

Furthermore, by adjusting the biasing force of the spring member 80 in any manner, it is possible to easily change the contact position and the contact mode between the damper pin 50 and the first damper abutting surface 38 and the second damper abutting surface 75.

In addition, in the present embodiment, the coefficient of friction of the first damper abutting surface 38 and the second damper abutting surface 75 becomes larger when approaching the outer side in the radial direction. Therefore, at the time of high rotational speed, as the frictional force between the damper pin 50 and the first damper abutting surface 38 and the second damper abutting surface 75 is large, it is possible to apply large attenuation to the excitation force. Accordingly, it is possible to apply appropriate attenuation to a response amplitude of the turbine rotor blade. Meanwhile, at the time of low rotational speed, as the frictional force between the damper pin 50 and the first damper abutting surface 38 and the second damper abutting surface 75 is small, it is possible to apply relatively small attenuation to the excitation force. Therefore, it is possible to stabilize the vibration response of the turbine 10 blade.

Modification Example of First Embodiment

Figure 4:
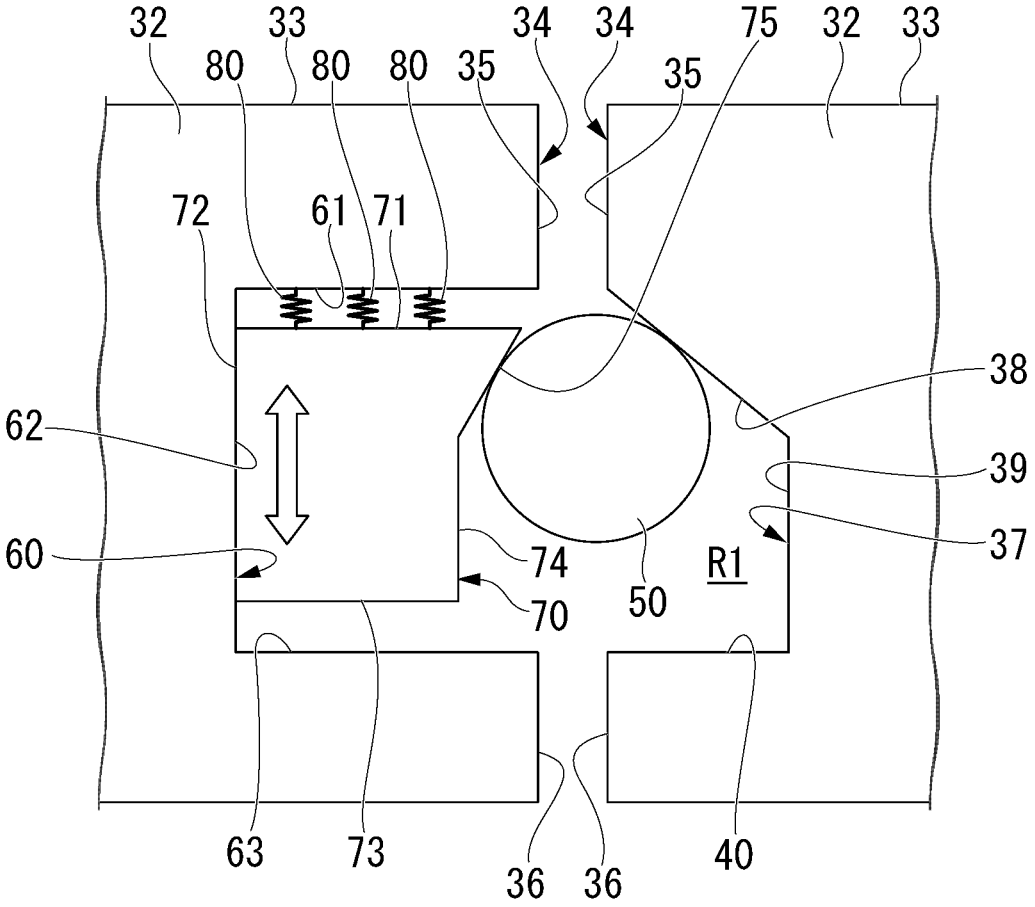
FIG. 4 is a view of a damper pin of the gas turbine according to a modification example of the first embodiment when viewed from the axial line direction.

For example, the configuration illustrated in FIG. 4 may be adopted as a modification example of the first embodiment. In the modification example, the first moving member 70 is movable in the radial direction. The rear surface (guided surface) 72 of the first moving member 70 is guided in the radial direction by the second recess portion bottom surface (guide surface) 62 of the second recess portion 60. Accordingly, the first moving member 70 is movable relative to the first damper abutting surface 38.

The spring member 80 of the modification example is installed between the second recess portion upper surface 61 in the second recess portion 60 of the other platform 32 and the outer peripheral surface 71 of the first moving member 70. A plurality of spring members 80 are installed at intervals in the peripheral direction. The spring member 80 is installed so as to be extensible and contractible in the radial direction. The spring member 80 elastically biases the first moving member 70 to the inner side in the radial direction with respect to the second recess portion upper surface 61 by being disposed in the compressed state.

In the modification example, the position in the radial direction of the first moving member 70 against which the damper pin 50 abuts changes by the centrifugal force acting on the damper pin 50. Accordingly, it is possible to change the contact position of the damper pin 50 with respect to the first damper abutting surface 38 and the second damper abutting surface 75. Therefore, similar to the first embodiment, it is possible to change the attenuation by the damper pin 50 in accordance with the rotational speed.

Second Embodiment

Figure 5:
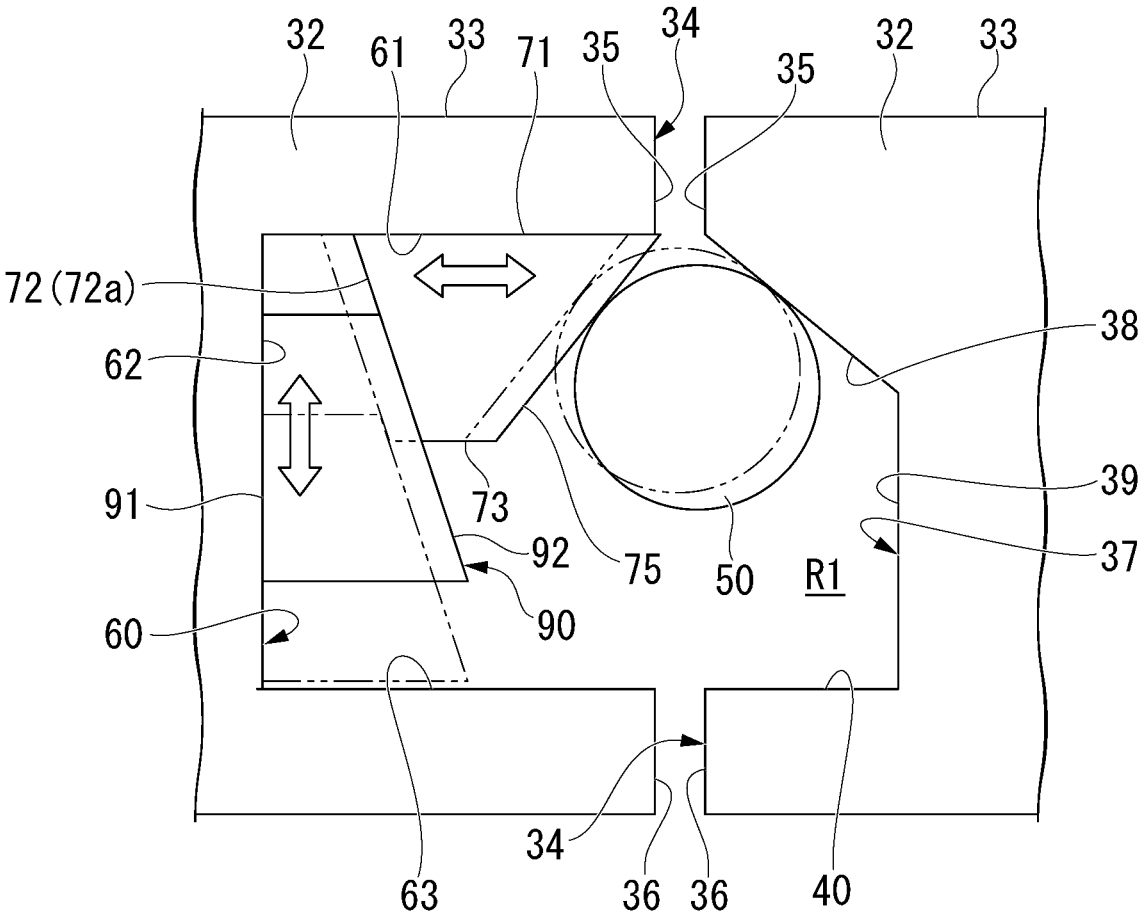
FIG. 5 is a view of a damper pin of a gas turbine according to a second embodiment when viewed from the axial line direction.

Next, a second embodiment of the present invention will be described with reference to FIG. 5. In the second embodiment, the same configuration elements as those of the first embodiment will be denoted by the same reference numerals, and the detailed description thereof will be omitted.

The rear surface 72 of the first moving member 70 of the second embodiment is a pressure-receiving surface 72*a*. The pressure-receiving surface 72*a* is inclined toward the other side in the peripheral direction as approaching the outer side in the radial direction. The pressure-receiving surface 72*a* is in a shape of a flat surface parallel to the axial line O.

In the second embodiment, a second moving member 90 is installed instead of the spring member 80 of the first embodiment as a biasing member. The second moving member 90 extends in a uniform outer shape in the axial line O direction.

Second Moving Member

The second moving member 90 is installed within the second recess portion 60 between the pressure-receiving surface 72*a* of the first moving member 70 and the second recess portion bottom surface 62 of the second recess portion 60. The surface facing the other side in the second moving member 90 in the peripheral direction is a first sliding abutting surface 91 slidably abutting against the second recess portion bottom surface 62 in the radial direction. As the first sliding abutting surface 91 is guided by the second recess portion bottom surface 62, the second moving member 90 is movable relative to the other platform 32 in the radial direction. Coating or the like having a small coefficient of friction may be formed on at least one of the first sliding abutting surface 91 and the second recess portion bottom surface 62 so as to make the sliding easy.

The surface facing the one side in second moving member 90 in the peripheral direction is a second sliding abutting surface 92. The second sliding abutting surface 92 extends to the other side in the peripheral direction as approaching the outer side in the radial direction. The second sliding abutting surface 92 is parallel to the pressure-receiving surface 72*a*, and slidably abuts against the pressure-receiving surface 72*a*. In other words, the second moving member 90 and the first moving member 70 are movable relative to each other while slidably abutting against each other along the extending direction of the second sliding abutting surface 92 and the pressure-receiving surface 72*a* in a section orthogonal to the axial line O. Similar to the description above, coating or the like for reducing the coefficient of friction may be formed on at least one of the second sliding abutting surface 92 and the pressure-receiving surface 72*a*.

Functional Effect

In the present embodiment, since the second moving member 90 is movable in the radial direction, when the centrifugal force acts on the second moving member 90, the second moving member 90 presses the pressure-receiving surface 72*a* of the first moving member 70 in accordance with the centrifugal force. Accordingly, as the second moving member 90 moves to the outer side in the radial direction while slidably abutting against the first moving member 70, the first moving member 70 moves to one side in the peripheral direction.

In addition, the position in the peripheral direction of the first moving member 70 changes due to the balance between the pressing force acting on the pressure-receiving surface 72*a* from the second moving member 90 and the pressing force acting from the damper pin 50. Accordingly, as described above, since the contact position of the damper pin 50 changes, it is possible to change the attenuation in accordance with the rotational speed.

Third Embodiment

Figure 6:
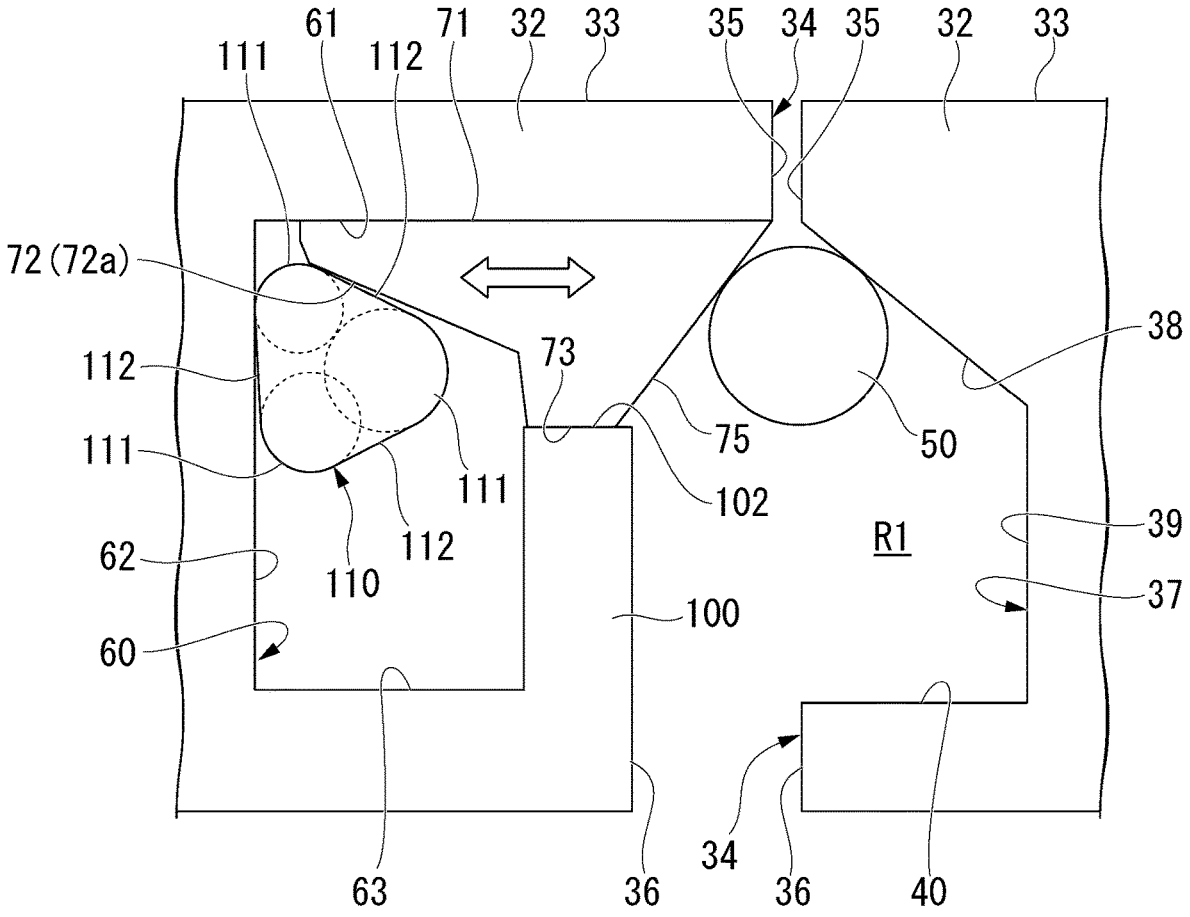
FIG. 6 is a view of a damper pin of a gas turbine according to a third embodiment when viewed from the axial line direction.

Next, a third embodiment of the present invention will be described with reference to FIG. 6. In the third embodiment, the same configuration elements as those of the first and second embodiments will be denoted by the same reference numerals, and the detailed description thereof will be omitted.

In the other platform 32 of the third embodiment, a wall portion 100 that is formed so as to extend to the outer side from the second recess portion lower surface 63 of the second recess portion 60 in the radial direction and covers a part of an opening of the second recess portion 60 is formed. The end portion on the outer side of the wall portion 100 in the radial direction is a support surface 102 supporting the inner peripheral side end surface 73 of the first moving member 70 from the inner side in the radial direction to be slidable in the peripheral direction. Similar to the second embodiment, the pressure-receiving surface 72*a* of the first moving member 70 of the third embodiment is inclined so as to extend to the other side in the peripheral direction as approaching the outer side in the radial direction.

Biasing Damper Pin

In addition, a biasing damper pin 110 (biasing member) is accommodated in the space on the other side of the wall portion 100 in the peripheral direction divided by the wall portion 100 in the second recess portion 60. The biasing damper pin 110 extends in a uniform shape in the axial line O direction. The biasing damper pin 110 can simultaneously come into contact with both the second recess portion bottom surface 62 and the pressure-receiving surface 72*a*. The outline having the sectional shape orthogonal to the axial line O of the biasing damper pin 110 has a non-rotationally symmetrical shape.

In the present embodiment, the outline shape orthogonal to the axial line O of the biasing damper pin 110 may be formed of a plurality of arcs 111 which are convex outward and have radiuses of curvature different from each other, and a plurality of line segments 112 connecting the arcs 111 to each other, as an example of the non-rotationally symmetrical shape. Accordingly, the outline shape of the biasing damper pin 110 has a non-rotationally symmetrical shape in which the same shape does not appear to overlap the outline shape even when a part of the outline shape is rotated in any manner.

Functional Effect

When the centrifugal force acts on the biasing damper pin 110 when the turbine 10 rotates, the biasing damper pin 110 comes into contact with both the second recess portion bottom surface 62 and the pressure-receiving surface 72*a*. The position in the peripheral direction of the first moving member 70 is determined by the balance between the pressing force from the biasing damper pin 110 and the pressing force of the damper pin 50 on one side in the peripheral direction.

Here, in the present embodiment, since the biasing damper pin 110 has the non-rotational target shape, the contact location between the biasing damper pin 110 and the pressure-receiving surface 72*a* randomly changes when the centrifugal force is applied. Accordingly, the pressing force acting on the pressure-receiving surface 72*a* from the biasing damper pin 110 changes. Therefore, as described above, since the contact position of the damper pin 50 changes due to the change of the position in the peripheral direction of the first moving member 70, it is possible to change the attenuation in accordance with the rotational speed.

In particular, in the present embodiment, by forming the outline having the sectional shape orthogonal to the axial line O of the biasing damper pin 110 with the arcs 111 and line segments 112 which are different from each other, it is possible to easily set the outline having the outer peripheral surface of the biasing damper pin 110 to have a non-rotationally symmetrical shape. Accordingly, it is possible to more randomly change the contact location of the biasing damper pin 110. In addition, since the region of the line segment 112 of the outline has a shape of a flat surface, it is possible to reduce the surface pressure by being in surface-contact with the pressure-receiving surface 72*a* and the second recess portion bottom surface 62.

Other Embodiments

Although the embodiments of the present invention have been described, not being limited thereto, the present invention can be appropriately changed within the range which does not depart from the technical idea of the invention.

In the embodiment, the configuration in which both the pair of damper abutting surfaces 38 and 75 are inclined with respect to the radial direction has been described. However, not being limited thereto, for example, one of the pair of damper abutting surfaces 38 and 75 may be inclined similar to the embodiment, and the other one may extend along the radial direction.

For example, in the embodiment, an example in which the turbine rotor blade 30 of the gas turbine 1 is employed has been described, but for example, the present invention may be applied to the rotor blade of another rotary machine, such as a jet engine rotor blade or a steam turbine rotor blade.

EXPLANATION OF REFERENCES

1 Gas turbine
2 Compressor
23
3 Compressor rotor
4 Compressor casing
5 Compressor rotor blade stage
6 Compressor rotor blade
7 Compressor stationary blade stage
8 Compressor stationary blade
9 Combustor
10 Turbine
11 Turbine rotor
11*a* Disk
12 Turbine casing
13 Turbine stationary blade stage
14 Turbine stationary blade
20 Turbine rotor blade stage
30 Turbine rotor blade
31 Blade root
32 Platform
33 Outer peripheral surface
34 Platform side surface
35 Outer peripheral side surface
36 Inner peripheral side surface
37 First recess portion
38 First damper abutting surface
39 First recess portion bottom surface
40 First recess portion lower surface
41 Blade main body
50 Damper pin (damper member)
60 Second recess portion
61 Second recess portion upper surface
62 Second recess portion bottom surface
63 Second recess portion lower surface
70 First moving member
71 Outer peripheral surface
72 Rear surface
72*a* Pressure-receiving surface
73 Inner peripheral side end surface
74 Front surface
75 Second damper abutting surface
80 Spring member (biasing member)
90 Second moving member

91 First sliding abutting surface
92 Second sliding abutting surface
100 Wall portion
102 Support surface
110 Biasing damper pin
111 Arc
112 Line segment
R1 Accommodation space
O Axial line

What is claimed is:

1. A rotary machine, comprising:

a rotating shaft configured to rotate around an axial line;

a plurality of rotor blades which are arranged in a peripheral direction on an outer peripheral side of the rotating shaft, and each having have a blade root attached to the rotating shaft, a platform installed on an outer side of the blade root in a radial direction, and a blade main body extending to the outer side from the platform in the radial direction; and damper pins each Installed on an inner side of the platform in the radial direction between the rotor blades adjacent to each other, wherein one of the platforms adjacent to each other in the peripheral direction has a first abutting surface extending in the radial direction and against which the damper pins abut, and wherein the rotary machine further comprises:

a first moving member which is installed to be movable relative to the first damper abutting surface between the platforms adjacent to each other in the peripheral direction and on which a second damper abutting surface against which the damper pins abut is formed while a relative distance with the first damper abutting surface decreases as opposing the first damper abutting surface in the peripheral direction and approaching the outer side in the radial direction; and a biasing member configured to bias the first moving member toward the damper pins abutting against the second damper abutting surface.

2. The rotary machine according to claim 1, wherein a coefficient of friction changes in a direction in which at least one of the first damper abutting surface and the second damper abutting surface extends in a sectional view orthogonal to the axial line.

3. The rotary machine according to claim 1, wherein the first moving member is installed to be movable in the peripheral direction, and wherein the biasing member is a spring member which is installed between the other platform and the first moving member and elastically biases the first moving member to one side in the peripheral direction.

4. The rotary machine according to claim 1, wherein the first moving member is installed to be movable in the radial direction, and wherein the biasing member is a spring member which is installed between the other platform and the first moving member and elastically biases the first moving member to the inner side in the radial direction.

5. The rotary machine according to claim 1, wherein the first moving member is installed to be movable in the peripheral direction, and has a pressure-receiving surface that is formed in an end portion on the other platform side and extends toward the other side in the peripheral direction as approaching the outer side in the radial direction, wherein the other platform has an opposing surface opposite to the pressure-receiving surface in the peripheral direction, and wherein the biasing member is capable of abutting against both the pressure-receiving surface and the opposing surface, and is movable in the radial direction.

6. The rotary machine according to claim 5, wherein the biasing member has a first sliding abutting surface slidably abutting against the pressure-receiving surface, and a second sliding abutting surface slidably abutting against the opposing surface.

7. The rotary machine according to claim 5, wherein the biasing member is a biasing damper pin extending uniformly in the axial line direction, and in which an outline having a sectional shape orthogonal to the axial line is a non-rotation target shape.

8. The rotary machine according to claim 7, wherein, in the biasing damper pin, the outline having a sectional shape orthogonal to the axial line is formed of a plurality of arcs which are convex outward and have radiuses of curvature different from each other, and a plurality of line segments connecting the arcs to each other.

* * * * *